United States Patent [19]

Phillips

[11] 4,153,275

[45] May 8, 1979

[54] CHECKBOOK COVER

[75] Inventor: John W. Phillips, Arden Hills, Minn.

[73] Assignee: Deluxe Check Printers, Inc., St. Paul, Minn.

[21] Appl. No.: 929,303

[22] Filed: Jul. 31, 1978

[51] Int. Cl.[2] ..... B42D 3/08

[52] U.S. Cl. ..... 281/17; 150/28 R; 150/35; 428/159; 428/173

[58] Field of Search ..... 150/39, 28 R, 34, 35; 281/17, 34, 31, 19 R, 4; 428/159, 173

[56] References Cited

U.S. PATENT DOCUMENTS

| | | | |
|---|---|---|---|
| 2,246,397 | 6/1941 | Traum | 281/34 |
| 2,647,071 | 7/1953 | Schade | 150/39 X |
| 2,828,975 | 4/1958 | Wright | 281/19 R |
| 3,161,216 | 12/1964 | Sloves | 281/19 R X |
| 3,861,718 | 1/1975 | Strus | 281/17 |

*Primary Examiner*—Donald F. Norton
*Attorney, Agent, or Firm*—Dorsey, Windhorst, Hannaford, Whitney & Halladay

[57] ABSTRACT

A simulated leather checkbook cover includes an outer cover sheet and an inner pocket-forming sheet of vinyl sheet material. The peripheral edge of the outer sheet is turned inwardly over and around the peripheral edge of the inner sheet, and the layers of the edge portion are secured to each other by a radio-frequency dielectric heat sealed vinyl-to-vinyl bond and by a line of threaded stitching extending through all three layers close to the turned over edge. The cover sheet has a flow-molded design portion in its outer surface with a depth and pattern simulating a hand-tooled leather design. The design portion includes a depressed flat area within which any selected one of a plurality of originally separate and differently ornamental inserts is adhesively secured. Each insert has a shape and thickness substantially fitting the depressed flat area and a leather-like outer surface simulating an integral tooled leather-like portion of the cover sheet design with different individual identification symbols on some of the respective inserts. The simulated hand-tooled leather design is enhanced by a selective antique coating in depressed portions of the design.

10 Claims, 5 Drawing Figures

CHECKBOOK COVER

FIELD OF THE INVENTION

This invention relates to the field of check book covers and more particularly to checkbook covers which are constructed from two or more layers of plastic sheet material.

DESCRIPTION OF THE PRIOR ART

Checkbook covers have previously been constructed from such materials as leather, as well as plastic sheet material. In such covers it has been customary to provide an outer cover sheet, which is secured to one or more inner pocket-forming sheets. Such sheets are connected at their peripheral edges to provide an inner receiving pocket into which the stiff backing member of a pad of checks can be inserted. The cover is normally folded around a center line so that part of the cover sheet also extends across and covers the pad of checks supported by such an inner pocket.

In the field of plastic checkbook covers, it has been customary to place the peripheral edges of the outer and inner plastic sheets in face to face relation with each other and to bond them together around the edge by a heat and pressure sealing step. It has also been customary to use various colors and patterns for the smooth outer surface of such a plastic cover sheet, including brown colors which may have been intended to look somewhat like a smooth leather surface. Some general surface effect patterns have also been embossed by rollers throughout the entire surface area of continuous sheet material from which such covers are to be cut.

In other fields, there have been some procedures and constructions which are intended to produce other types of articles in which vinyl sheet material look less like smooth synthetic or plastic material and perhaps more like an expensive material such as leather. For example, techniques are known by which designs can be molded by a flow molding process into a surface of expanded vinyl sheet material. Equipment is also known for turning the peripheral edges of an outer plastic sheet around the peripheral edges of an inner sheet and heat sealing these portions together. In the field of hand tooled leather goods, it is also known to turn the outer edges of one leather piece around the peripheral edges of another and secure the pieces together by stitching.

In an effort to personalize various products, manufacturers and suppliers have been known to furnish with a particular article an individual initial or monogram which can be affixed to the surface of the article in some known manner, e.g. by adhesive. Such added letters, however, do not seem to give the appearance of being part of an original design portion of the article surface.

In fields other than checkbook covers, it has also been known to enhance the appearance of a relief design in plastic sheet material, for example, by coating the surface of the design with a so called "antiquing" solution, and then wiping off the solution from the normal uppermost surface areas of the design, thus leaving some of the antiquing solution as a coating in the depressed areas of such a design. Such solutions and techniques are known and available per se.

Applicant is not aware, however, of checkbook cover constructions prior to the present invention, in which a cover can be formed of plastic sheet materials and simulate to a high degree the appearance of an expensive leather checkbook cover with a hand tooled design in its outer surface, turned over edges secured by stitching, with an individual monogram or other symbol or with an antique leather appearance at depressed areas of the design.

SUMMARY OF THE INVENTION

According to the present invention, an improved simulated leather checkbook cover is provided which includes a leather-like outer cover sheet of heavy gauge expanded unsupported vinyl sheet material and an inner pocket-forming sheet of vinyl material, in which the outer peripheral edge of the cover sheet is turned inwardly over and around the entire peripheral edge of the inner sheet to provide a three-layer folded edge portion, and in which layers of this edge portion are secured to each other around the entire periphery of the cover by a combination of a heat and pressure sealed vinyl-to-vinyl bond and a line of threaded stitching which extends through all three layers inwardly of and close to the fold formed by the turned over edge. Such a checkbook cover construction preferably also includes a flow-molded relief design portion formed in a limited area of the outer cover sheet. Such design portion further includes a depressed flat area of predetermined shape surrounded by less depressed portions of the cover sheet, in combination with an originally separate ornamental insert adhesively secured within the depressed flat area and having a shape and thickness substantially fitting the area and thereby simulating an integral tooled leather-like portion of the cover sheet.

The preferred checkbook cover further provides such an ornamental insert of vinyl sheet material similar to the outer cover sheet material and with a suitable relief design portion in the ornamental insert itself, such ornamental design portion providing a suitable identifying letter, monogram or other personalized identifying symbol in a depth and pattern simulating a hand-tooled leather design. Such simulated tooled leather design is further enhanced by selective chemical antiquing treatment of the depressed portions of the respective designs. Any one of a plurality of originally separate and individually different ornamental inserts may be selected and combined with a common cover design to provide customized checkbook covers with different identification symbols for different customers.

Other features and embodiments of the present invention will be apparent from the following detailed description of a preferred embodiment.

BRIEF DESCRIPTION OF THE DRAWINGS

In the drawings which accompany and form a part of this specification, and in which like reference characters indicate like parts.

DESCRIPTION OF THE PREFERRED EMBODIMENTS

Figures 1, 2, 3, 4, 5:
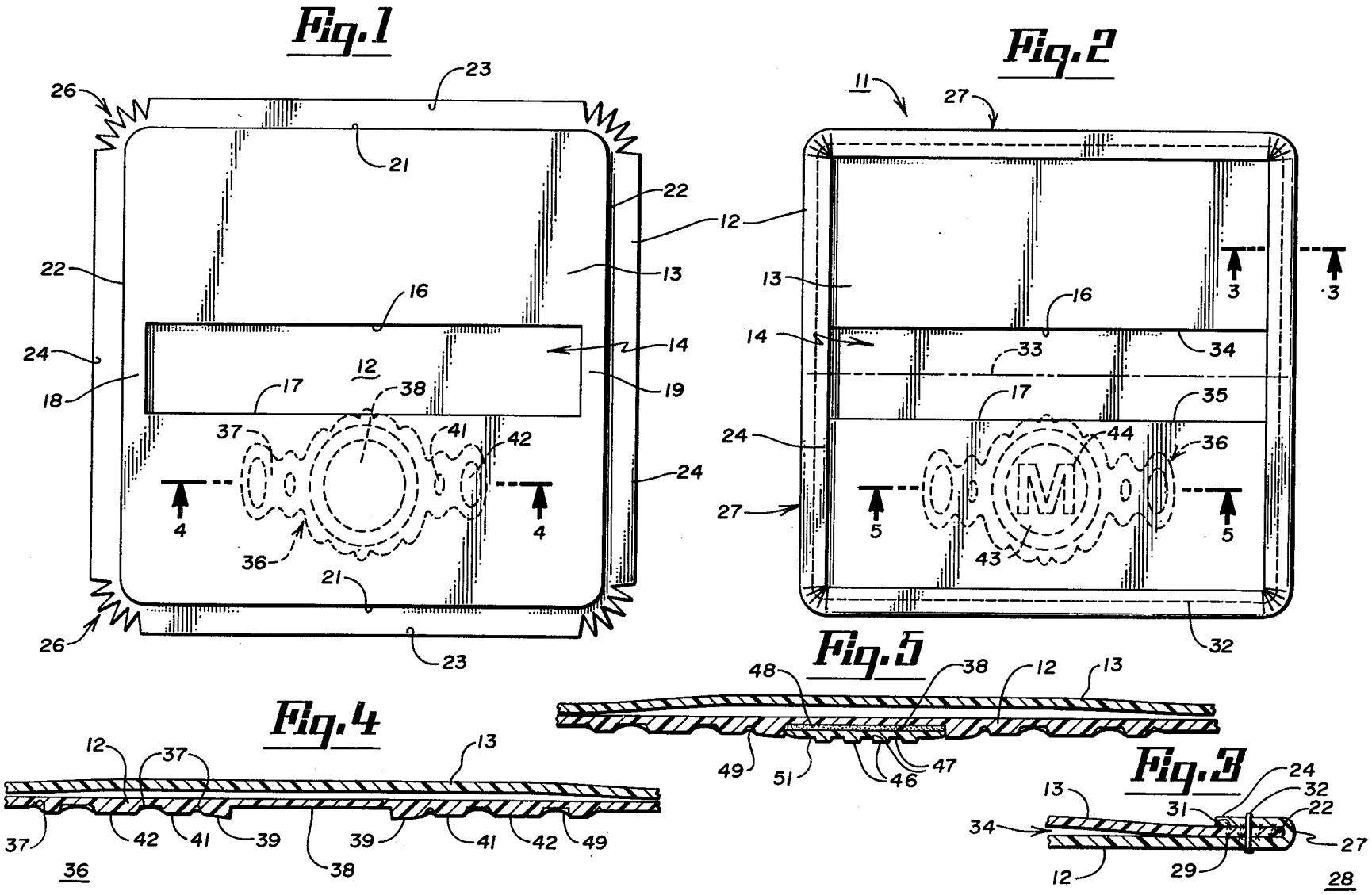
FIG. 1 is a top view showing the manner in which an inner pocket-forming sheet is superimposed on a plastic outer checkbook cover sheet as part of the process of constructing a checkbook cover embodying the present invention.
FIG. 2 is a view similar to FIG. 1, showing the completed checkbook cover in its finished form, as combined with an originally separate ornamental insert.
FIG. 3 is a partial sectional view on the line 3—3 of FIG. 2 showing details of the construction and connection of the folded edges of the checkbook cover.
FIG. 4 is a partial sectional view on the line 4—4 of FIG. 1, showing details of a design portion flow-molded in the outer surface of the outer cover sheet.
FIG. 5 is a partial sectional view similar to FIG. 4, as taken on the line 5—5 of FIG. 2 and illustrating the assembled combination of the checkbook cover with its originally separate ornamental insert.

A completed checkbook cover according to the present invention is shown generally at 11 in FIG. 2. FIG. 1 shows certain parts in registration before they are connected. The cover includes a leather-like outer cover sheet 12 of heavy gauge expanded unsupported vinyl sheet material, in combination with an inner pocket-forming sheet 13 which is cut to provide a central opening 14 defined by longitudinal edges 16 and 17 and connecting edge portions 18 and 19. The inner sheet or cover blank can be made of thinner gauge vinyl sheet material and its periphery is defined by longitudinal edges 21 and transverse edges 22 which are shorter than the corresponding peripheral edges 23 and 24 of the outer cover blank or sheet 12. Thus the sheets can be originally superimposed as shown in FIG. 1 and the extended peripheral edges of the outer cover sheet 12 can then be turned inwardly over and around the entire peripheral edge of the inner sheet to form a three-layer folded edge portion as shown in FIG. 3. The corners of the outer cover sheet are notched as shown at 26 to eliminate excessive material at the folded over corners.

As further shown in FIG. 3, the superimposed layers inwardly of the outer folded edge 27 are secured to each other as generally indicated at 28. Specifically, the layers are sealed to each other at 29 and 31, such sealing being accomplished by a suitable dielectric heat sealing press with turning dies and equipment features which provide a sealed vinyl-to-vinyl bond between these layers. The edge connection further includes the combination with such a heat sealed bond of a line of stitching or sewing which extends all around the periphery of the checkbook cover as shown at 32, within the area of the turned over edge. Such stitching extends through all three layers of material. According to the present invention, such stitching offers the double advantage of providing a more effective bond or connection at the edges and also providing an appearance more closely simulating the possible stitching of a more expensive leather checkbook cover, in which the stitching would provide the sole connection between such superimposed and turned over edges. Thus, the combination of stitching and dialelectric sealing provides more leeway in the welding or heat sealing part of the process, since the welding or heat sealing under pressure need not be as tight as might be necessary for a heat seal alone to withstand the stresses of normal use. A suitable radio frequency dielectric heat and pressure sealing device capable of forming vinyl-to-vinyl bonds may be obtained from Louis G. Freeman Co. of Cincinnati, Ohio.

In such use, the checkbook cover of FIG. 2 is folded on its longitudinal axis shown by the line 33 to fully cover the flat surfaces of a pad of checks having a backing member which can be inserted within the pocket area 34 at the longitudinal edge 16 of the opening 14 in the inner sheet. A stiff backing member of a check register can be inserted in the remaining pocket during such use.

According to a further feature of the invention, the outer cover sheet 12 is provided, during its preliminary processing, with a molded design portion indicated generally at 36. Such a design portion may be formed in the outer cover blank at a flow mold station with known flow molding equipment, after the outer cover blanks have been cut from a continuous sheeted roll, for example by a known guillotine cut. At such a flow molding station, a mold in which a mirror image of the desired design has been formed is engaged against the outer surface of each individual outer cover blank and the material is heated and pressed against the mold to 37 flow" into the desired relief pattern. The thickness of the depressed portions of the design can be as little as 30 to 35 gauge, where the original starting material may have been a 60 gauge sheet of expanded unsupported vinyl material. Thus the molded design portion 36 on the outer surface of the outer cover blank includes the depressed portions 37 of the type which would be made, for example, by the hand tooling of a similar leather blank. One of these depressed portions in the preferred embodiment of the invention involves a flat area 38, which is intended to receive an originally separate ornamental insert 44, after the basic construction of the checkbook cover is otherwise complete. In this case the flat design receiving area 38 involves an oval area, and the design further includes undepressed or higher areas such as the oval boundary 39 around flat area 38, as well as other undepressed design areas is shown at 41 and 42 which are surrounded by other portions 37.

The relief design formed by the flow molding step is preferably located in only a limited or partial area of the checkbook cover. In this example, the design is molded in that half of the cover blank which forms part of pocket 35, and there is no cover design in the area of pocket 34. Pocket 34 would normally be at the bottom of the cover in normal use with a pad of checks in that pocket. Thus the relief design is formed only in the top area of the cover, above pocket 35 which may carry a check register. The design is further shown as covering only a limited portion of the area above pocket 35.

Suitable flow molding equipment for forming such relief designs may be obtained from Compo Industries of Waltham, Massachusetts.

When the design portion 36 has been formed by flow molding, the outer cover blank is then appropriately centered and its edges finally die-cut to the proper dimensions in a known type of clicking die, in which the original slightly larger cover blank cut from the sheeted roll is accurately positioned by the use of locating points in the design, to avoid any errors due to changes of dimension as the material was formed into the desired design by the flow molding step. The inner cover blanks are die-cut from thinner gauge vinyl sheet material, placed in registration with the outer blanks, and placed in the dielectric sealing press with turning dies, in which the outer edges of the outer cover blank are turned inwardly over and around the peripheral edge of the inner blank to form the edge construction described in connection with FIG. 3.

At that point, and before the cover is sent to a sewing unit for the perimeter stitching 32, the invention contemplates an antique treatment of the cover design, in which a known chemical antiquing material for vinyl sheeting use is applied, e.g. by airbrush, to the outer surface of the cover and is then hand wiped from the high spots or undepressed areas of the cover. Thus the antiquing material will remain in the depressed areas for desired effect as shown at 49 in FIGS. 4 and 5. Such remaining antique material may give a darker color, for example, to the depressed areas, which thus enhances the simulated tooled leather appearance of the design, like a piece of hand tooled and well cared for leather.

At this stage, the checkbook cover is complete except for the preferred addition of an originally separate ornamental insert 43. The preferred insert is also made of vinyl sheet material of the same general color as the outer cover blank, and has a flat inner surface and an appropriate thickness adopted to fit the depressed oval area 38 of the cover sheet design. The insert has a relief design on its outer surface adopted to mesh with and appear as a continuation or integral portion of the simulated tooled leather design portion of the cover sheet. The relief design may include some monogram or letter 46, such as the letter "M" shown in FIGS. 2 and 5. In this case the outer surface of the letter is represented by an undepressed portion of the vinyl insert, and is outlined or emphasized by a depressed area 47 around the letter. This depressed area may be further designed to give a somewhat stippled effect, as often provided by one type of hand-tooled leather design.

To facilitate the insertion of the ornamental insert 43 in the flat design receiving area 38 of the outer cover surface, the insert is preferably provided with a layer of pressure sensitive adhesive 48, which may be initially covered by a protective sheet (not shown) which is removed just prior to the insertion of the insert into the receiving area 38. The design portion of such an insert is not necessarily limited to a letter of the alphabet, but may include any other identifying symbol, such as one of the signs of the zodiac, which might be suitable for identification of a particular purchaser of such a checkbook cover or which such a purchaser might consider unique and distinctive from the purchaser's point of view, as compared to other possible monograms or design inserts. The invention accordingly provides the advantages of manufacturing improved checkbook covers with a common basic design and then completing such covers with any selected one of a plurality of individually different ornamental inserts which give the impression of a customized integral cover and design for each different individual insert.

As shown in FIG. 5, the relief design in the ornamental insert surface may also be the subject of an antique treatment step, which will leave the antiquing material in the depressed areas, as indicated at 51. Suitable antique liquids are commercially available, e.g. from K. J. Quinn & Company, Inc. of Malden, Massachusetts.

The relief designs in the separate ornamental inserts or medallions might be made by a flow molding process, as in the case of the cover relief design. In the illustrated embodiment, however, the inserts are cut from vinyl sheet material and then sent to a heated sealing press in which the inital is formed by a brass hand-cut die which compresses the areas around such a letter.

The invention described herein provides an improved simulated leather checkbook cover, in which the simulated hand tooled leather appearance of the cover and its design is enhanced by the unique combination in such a checkbook cover of the described features, some of which have been individually known in connection with fields other than the construction and processing of checkbook covers, or even in the case of the dielectric heat sealing of vinyl outer and inner cover sheets, individually known in the production of vinyl or other plastic checkbook covers which do not simulate the appearance of fine leather. The foregoing specification sets forth certain preferred embodiments and modifications of the invention and some of the ways in which the invention may be put into practice, including the best mode presently contemplated by the inventor for carrying out this invention. Modifications of the described embodiment, as well as alternate embodiments and devices for carrying out the invention may also be apparent to those skilled in the art, within the spirit and scope of the following claims:

I claim:

1. A simulated leather checkbook cover comprising a leather-like outer sheet of heavy gauge expanded unsupported vinyl sheet material having a peripheral edge, and an inner pocket-forming sheet of vinyl material having a peripheral edge engaging the inner surface of the outer sheet close to the peripheral edge of the outer sheet, the outer peripheral edge of the outer sheet being turned inwardly over and around the entire peripheral edge of the inner sheet as part of a three-layer folded edge portion, the layers of said edge portion being secured to each other around the entire periphery of the cover by a heat and pressure sealed vinyl-to-vinyl bond and by a line of threaded stitching extending through all three layers inwardly of and close to the fold formed by the turned over edge.

2. A checkbook cover according to claim 1 having a flow-molded relief design portion formed in an outer surface area of the outer sheet.

3. A checkbook cover according to claim 2 in which the flow-molded relief design has a depth and pattern simulating a hand-tooled leather design and extends over only a limited portion of the outer surface area of the outer sheet.

4. A checkbook cover according to claim 3 in which the simulated tooled leather design is enhanced by a selective chemical antique coating in the depressed portions of the design.

5. A checkbook cover according to claim 2 in which the design portion includes a depressed flat area of predetermined shape surrounded by relatively higher portions of the outer sheet, said cover also having an originally separate ornamental insert adhesively secured within said depressed flat area, said insert having a shape and thickness substantially fitting the depressed flat area and simulating an integral tooled leather-like portion of the outer sheet design.

6. A checkbook cover according to claim 5 in which the ornamental insert has an individual identification symbol on its outer surface.

7. A checkbook cover according to claim 6 in which the individual identification symbol includes a letter of the alphabet.

8. A plurality of checkbook covers according to claim 6 in which the ornamental inserts in the respective covers have different individual identification symbols.

9. A checkbook cover according to claim 5 in which the flow-molded relief design portion of the outer surface of the outer sheet has a depth and pattern simulating a hand-tooled leather design and in which such design is enhanced by a selective antique coating in depressed portions of the design.

10. A checkbook cover according to claim 9, in which the ornamental insert has an individual identification symbol on its outer surface.

* * * * *